US011035602B2

(12) United States Patent
Bertolini et al.

(10) Patent No.: US 11,035,602 B2
(45) Date of Patent: Jun. 15, 2021

(54) CLEAR ICE MAKER ASSEMBLY FOR PRODUCTION AND STORAGE OF CLEAR ICE WITHIN A HOME REFRIGERATOR APPLIANCE

(71) Applicants: BSH Home Appliances Corporation, Irvine, CA (US); BSH Hausgeräte GmbH, Munich (DE)

(72) Inventors: Nilton Bertolini, Knoxville, TN (US); Silas Patrick Mallon, Knoxville, TN (US); Jorge Carlos Montalvo Sanchez, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 161 days.

(21) Appl. No.: 16/429,102

(22) Filed: Jun. 3, 2019

(65) Prior Publication Data

US 2020/0378670 A1 Dec. 3, 2020

(51) Int. Cl.

| | |
|---|---|
| ***F25C 1/18*** | (2006.01) |
| ***F25C 1/04*** | (2018.01) |
| ***F25C 5/182*** | (2018.01) |

(52) U.S. Cl.
CPC ..... *F25C 1/18* (2013.01); *F25C 1/04* (2013.01); *F25C 5/182* (2013.01)

(58) Field of Classification Search
CPC ..... F25C 1/18; F25C 1/04; F25C 5/182
USPC ..... 62/344
See application file for complete search history.

(56) References Cited

U.S. PATENT DOCUMENTS

| | | | | |
|---|---|---|---|---|
| 3,026,684 | A * | 3/1962 | Chace | F25C 1/04 62/132 |
| 3,043,117 | A * | 7/1962 | Bollefer | F25C 1/045 62/344 |
| 9,163,867 | B2 | 10/2015 | Culley | |
| 9,273,891 | B2 | 3/2016 | Boarman et al. | |
| 9,574,811 | B2 | 2/2017 | Papalia | |
| 9,651,290 | B2 | 5/2017 | Boarman et al. | |
| 9,696,079 | B2 | 7/2017 | Boarman et al. | |
| 9,719,711 | B2 | 8/2017 | Bortoletto et al. | |
| 9,746,229 | B2 | 8/2017 | Visin et al. | |
| 9,816,744 | B2 | 11/2017 | Boarman et al. | |
| 9,915,459 | B2 | 3/2018 | Wu | |
| 10,254,032 | B2 * | 4/2019 | Knatt | F25C 1/045 |
| 10,746,452 | B2 * | 8/2020 | Chen | F25C 5/14 |

* cited by examiner

*Primary Examiner* — Ana M Vazquez
(74) *Attorney, Agent, or Firm* — Michael E. Tschupp; Andre Pallapies; Brandon G. Braun

(57) ABSTRACT

A clear ice maker assembly for use in a home refrigerator appliance, the clear ice maker assembly including: an evaporator plate that is cooled via contact with a refrigerant tube; at least one thermally non-conductive ice mold part disposed below the evaporator plate and having one or more walls that together with a surface of the evaporator plate form an ice mold cavity; a spray bar having at least one opening for introducing water vertically into the ice mold cavity such that a clear ice piece forms on the surface of the evaporator plate inside the ice mold cavity of the at least one thermally non-conductive ice mold part; a water reservoir system configured to supply water to the spray bar; and an ejection system configured to eject the clear ice piece formed inside the ice mold cavity of the at least one thermally non-conductive ice mold part.

22 Claims, 9 Drawing Sheets

CLEAR ICE MAKER ASSEMBLY FOR PRODUCTION AND STORAGE OF CLEAR ICE WITHIN A HOME REFRIGERATOR APPLIANCE

FIELD OF THE INVENTION

The present disclosure relates generally to a refrigerator appliance and to a clear ice maker assembly for producing clear ice for the refrigerator appliance. More particularly, the present disclosure relates to an automatic clear ice maker assembly for producing clear ice pieces that contain little or no impurities and are substantially free of trapped air, and to a clear ice maker assembly that can be disposed in the refrigerator appliance.

Moreover, the automatic clear ice maker assembly can be positioned, for example, in a freezer compartment, or in a dedicated ice making compartment located within a fresh food compartment of the refrigerator appliance or in a freezer compartment of the refrigerator appliance.

BACKGROUND OF THE INVENTION

In general, some users/customers prefer clear ice pieces that are free of impurities and trapped air for beverages and cocktails, because such clear ice pieces are not only aesthetically pleasing but also avoid altering the taste of the beverages and cocktails in which they are used.

There are known standalone or dedicated clear ice making machines for home and commercial use which can produce clear ice. However, these standalone clear ice machines are typically of substantial size and have high ice rates, and therefore consume significant amounts of water and energy. Moreover, the known standalone clear ice machines generally have no practical means of storing the produced clear ice pieces for extended periods of time. In particular, all of these conventional product designs passively refrigerate the storage compartment, resulting in above freezing storage temperatures and significant melting of the stored ice pieces. This is largely due to the very wet nature or the ice produced by these machines, resulting in ice pieces that cannot be actively refrigerated for preservation as significant clumping would result. As the ice harvested from a conventional ice machine relies solely on gravity to release the ice from the evaporator, the evaporator must be heated to temperatures substantially above freezing. As a result, the ice pieces melt appreciably during this process and a very wet ice results. Attempting to store these wet ice pieces is not possible due to the extreme clumping that would result in a sub-freezing ambient temperature. These issues result in a substantially limited storage time, and the available ice continues to melt and become increasingly wet and low in quality. In addition, the accumulated meltwater must be dealt with; this is typically accomplished by pumping the meltwater to a drain that the appliance must be connected to, resulting in significant waste water and added complication of the appliance.

These factors make the currently available clear ice products unsuitable for the light use that a domestic or home ice maker would experience in a typical household.

SUMMARY OF THE INVENTION

However, there is currently no home or domestic refrigerator appliance on the market with an installed automatic clear ice maker that is capable of producing clear ice pieces that contain little or no impurities and are substantially free of trapped air, as well as providing a capability to store the clear ice pieces.

An apparatus consistent with the present disclosure is directed to providing an automatic clear ice maker assembly that can be equipped in a refrigerator appliance at the time of manufacture.

An apparatus consistent with the present disclosure is directed to providing an automatic clear ice maker assembly that can be positioned for example in a dedicated ice making compartment located within a fresh food compartment of the refrigerator appliance or in a freezer compartment of the refrigerator appliance.

An apparatus consistent with the present disclosure is directed to providing an automatic clear ice maker assembly that can produce clear ice pieces in a variety of shapes and sizes and can be easily changed by replacement of an ice mold part by the user.

An apparatus consistent with the present disclosure is directed to providing an automatic clear ice maker assembly that can produce clear ice pieces that are dry enough after harvesting that they can be effectively stored without clumping.

An apparatus consistent with the present disclosure is directed to providing an automatic clear ice maker assembly that can produce clear ice pieces at a high rate of ice production and is highly efficient in terms of water and energy use when compared to available commercial clear ice machines.

According to one aspect, the present disclosure provides a refrigerator comprising: an ice compartment region disposed in at least one of a fresh food compartment or a freezer compartment; a clear ice maker assembly disposed in the ice compartment region and configured to make clear ice pieces; and an ice storage bucket configured to store the clear ice pieces made by the clear ice maker assembly, wherein the clear ice maker assembly comprises: an evaporator plate that is cooled via contact with a refrigerant tube; at least one thermally non-conductive ice mold part disposed below the evaporator plate and having one or more walls that together with a surface of the evaporator plate form an ice mold cavity; a spray bar having at least one opening for introducing water vertically into the ice mold cavity such that a clear ice piece forms on the surface of the evaporator plate inside the ice mold cavity of the at least one thermally non-conductive ice mold part; a water reservoir system configured to supply water to the spray bar; and an ejection system configured to eject the clear ice piece formed inside the ice mold cavity of the at least one thermally non-conductive ice mold part and into the ice storage bucket.

According to another aspect, the surface of the evaporator plate comprises at least a lower surface.

According to another aspect, the at least one thermally non-conductive ice mold part comprises a plurality of thermally non-conductive ice mold parts each having one or more walls that together with the lower surface of the evaporator plate form a plurality of ice mold cavities for forming clear ice pieces.

According to another aspect, the ice mold cavities are configured in a variety of shapes and/or sizes.

According to another aspect, the thermally non-conductive ice mold parts are interchangeable such that the shape and/or size thereof are changeable.

According to another aspect, the water reservoir system comprises a water tank and a pump configured to supply water under pressure from the water tank to the spray bar.

According to another aspect, the spray bar comprises a plurality of openings respectively corresponding to the plurality of ice mold cavities.

According to another aspect, the ejection system comprises at least one ejector pin configured to push out the clear ice piece formed inside the ice mold cavity of the at least one thermally non-conductive ice mold part during an ice harvesting mode.

According to another aspect, the ejection system comprises a plurality of ejector pins configured to push out the clear ice pieces respectively formed inside the ice mold cavities during an ice harvesting mode.

According to another aspect, the ice maker assembly further comprises a grate disposed under the ice mold cavities and above a water tank of the water reservoir system and configured to guide the harvested clear ice pieces to slide down into the ice storage bucket and also allow any water to flow back into the water tank.

According to another aspect, the present disclosure provides a clear ice maker assembly for use in a home refrigerator appliance, the clear ice maker assembly comprising: an evaporator plate that is cooled via contact with a refrigerant tube; at least one thermally non-conductive ice mold part disposed below the evaporator plate and having one or more walls that together with a surface of the evaporator plate form an ice mold cavity; a spray bar having at least one opening for introducing water vertically into the ice mold cavity such that a clear ice piece forms on the surface of the evaporator plate inside the ice mold cavity of the at least one thermally non-conductive ice mold part; a water reservoir system configured to supply water to the spray bar; and an ejection system configured to eject the clear ice piece formed inside the ice mold cavity of the at least one thermally non-conductive ice mold part.

According to another aspect, the surface of the evaporator plate comprises at least a lower surface.

According to another aspect, the at least one thermally non-conductive ice mold part comprises a plurality of thermally non-conductive ice mold parts each having one or more walls that together with the lower surface of the evaporator plate form a plurality of ice mold cavities.

According to another aspect, the ice mold cavities are configured in a variety of shapes and/or sizes.

According to another aspect, the thermally non-conductive ice mold parts are interchangeable such that the shape and/or size thereof are changeable.

According to another aspect, the water reservoir system comprises a water tank and a pump configured to supply water under pressure from the water tank to the spray bar.

According to another aspect, the spray bar comprises a plurality of openings respectively corresponding to the plurality of ice mold cavities.

According to another aspect, the ejection system comprises at least one ejector pin configured to push out the clear ice piece formed inside the ice mold cavity of the at least one thermally non-conductive ice mold part during an ice harvesting mode.

According to another aspect, the ejection system comprises a plurality of ejector pins configured to push out the clear ice pieces respectively formed inside the ice mold cavities during an ice harvesting mode.

According to another aspect, the ice maker assembly further comprising a grate disposed under the ice mold cavities and above a water tank of the water reservoir system and configured to guide the harvested clear ice pieces to slide down over the water tank and also allow any water to flow back into the water tank.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 10A:
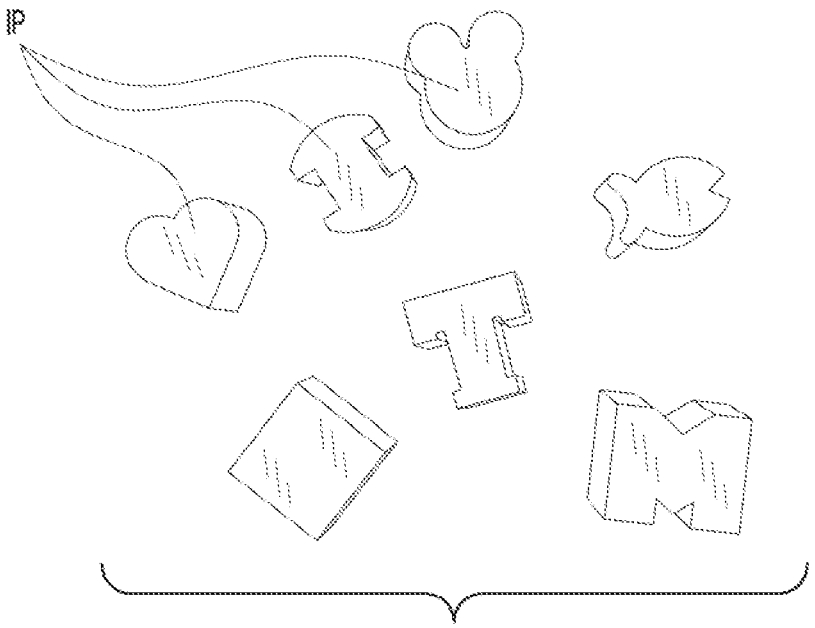
Figure 10B:
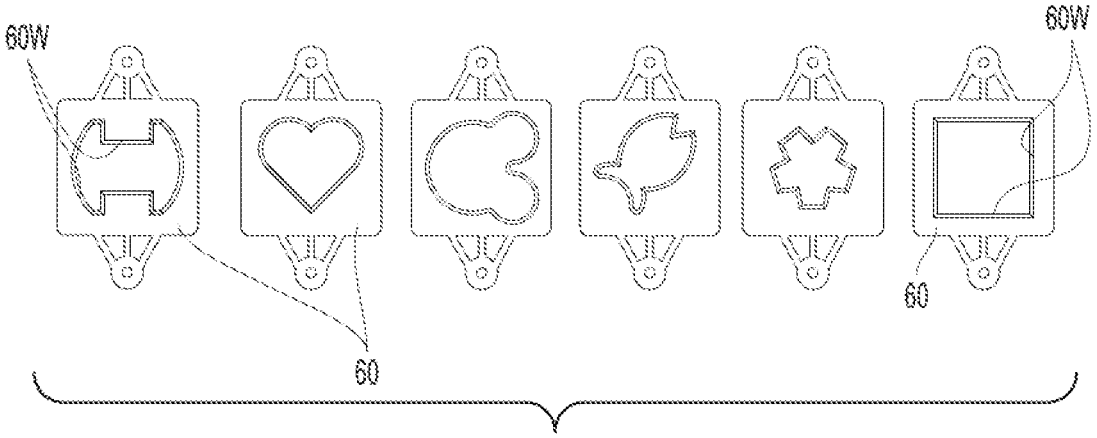
Figure 11:
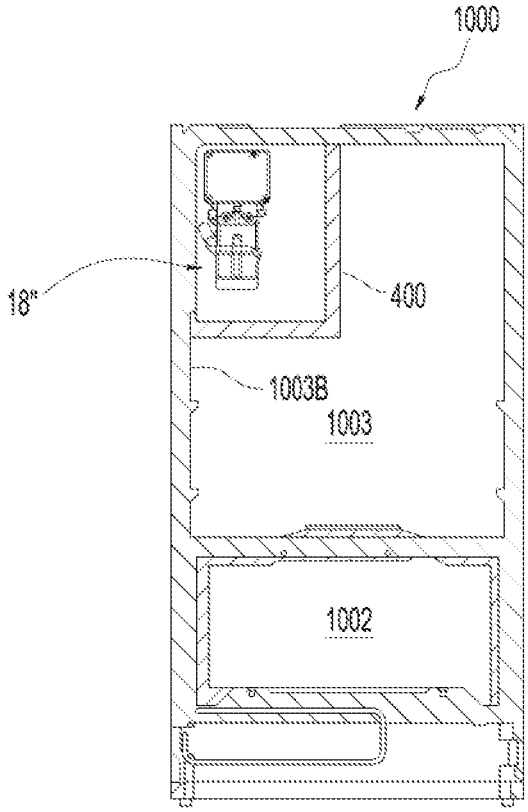

FIGS. 10A and 10B show examples of the clear ice pieces of various shapes that are produced and interchangeable ice molds, respectively, according to an exemplary embodiment consistent with the present disclosure; and FIG. 11 is a front cross-sectional view of a French door-bottom mount style refrigerator having a dedicated ice compartment, where the doors of the refrigerator are removed and the ice bucket with front cover of the ice compartment is removed for ease of understanding according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

As used herein, the terms "clear ice" or "clear ice pieces" refer to ice or ice pieces that are substantially free of impurities and are substantially free of trapped air. The clear ice or clear ice pieces are not limited to a particular shape or size. Impurities commonly found in ice, such as dissolved minerals and salts, can significantly alter the taste of a beverage. These impurities can also result in oxidation occurring in some beverages, further reducing the quality of the beverage. An apparatus consistent with the present disclosure is directed to providing an automatic clear ice maker that is capable of producing clear ice pieces that are substantially free of impurities and are substantially free of trapped air, as well as providing a capability to store the clear ice pieces produced.

Figure 1:
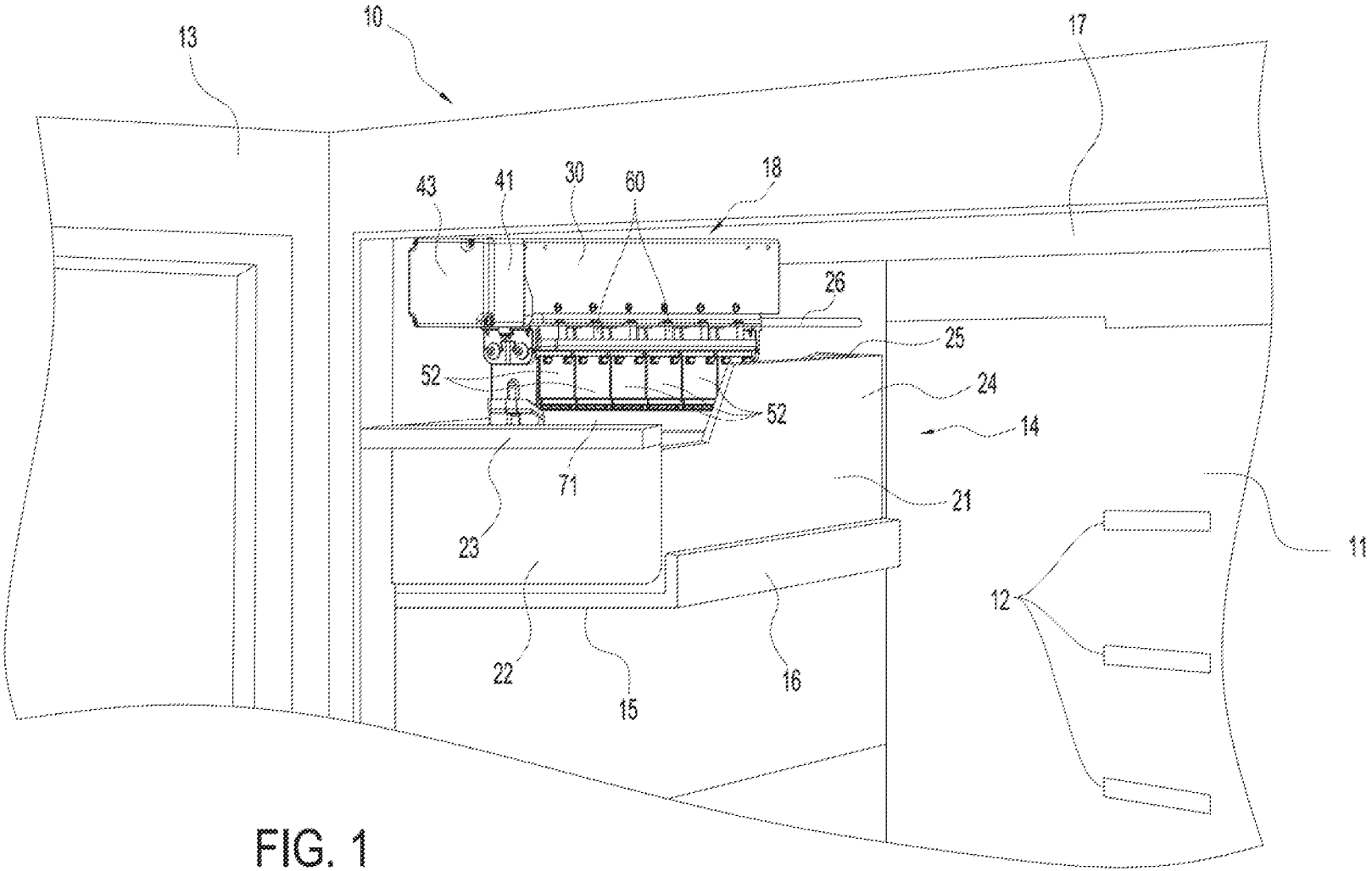
FIG. 1 is a fragmentary perspective view showing the inside of a refrigerator appliance including an automatic clear ice maker assembly in an ice compartment region located in a freezer compartment according to an exemplary embodiment consistent with the present disclosure.

FIG. 1 is a fragmentary perspective view showing the inside of a refrigerator appliance 10 including an automatic clear ice maker assembly 18 in an ice compartment region 14 located in a freezer compartment 11 according to an exemplary embodiment consistent with the present disclosure.

More specifically, FIG. 1 shows a home or domestic refrigerator appliance 10 and, in particular, the inside of the freezer compartment 11 having openings 12 for introducing cold air, with the return air opening not being visible in the figure. At least one door, or alternatively a drawer 13 is mounted such as by hinges or slides, for providing access to and for closing the freezer compartment 11. In the upper left corner, for example, an ice compartment region 14 is provided and is at least partially defined by an L-shaped floor portion 15. Although the L-shaped floor portion 15 is shown with a short vertical side wall 16, the vertical side wall 16 can extend, for example, halfway or all the way to the ceiling 17 of the freezer compartment 11. An automatic clear ice maker assembly 18 is disposed in the uppermost left corner of the freezer compartment 11 in the ice compartment region 14. The automatic clear ice maker assembly 18 is configured to make clear ice pieces.

Figure 9:
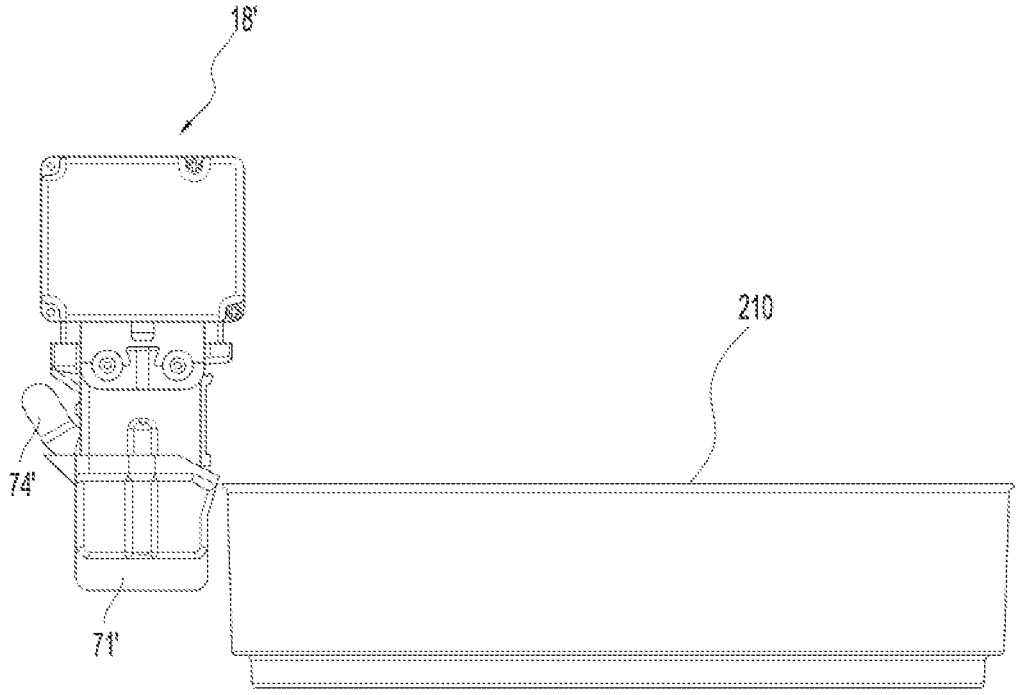
FIG. 9 is a front elevational view of the automatic clear ice maker assembly showing a variation of the ice storage bucket according to an exemplary embodiment consistent with the present disclosure.

As shown in FIG. 1, an ice storage bucket 21 is provided underneath and extends beyond one side of the automatic clear ice maker assembly 18. Alternatively, as shown in FIG. 9, the ice storage bucket 210 can be positioned beside the automatic clear ice maker assembly 18'. Although the term ice storage bucket is used, ice bucket, ice bin, ice storage container, and the like are alternative terms for describing the ice storage bucket 21. The ice storage bucket 21 is shown as a removable ice bucket for storing ice, the removable ice storage bucket being removably disposed in the ice compartment region 14. The ice storage bucket 21 has a front portion 22 with a grip 23 for a user to grasp with their fingers to pull and slide the ice storage bucket 21 out of the ice compartment region 14 to access the clear ice pieces or empty the clear ice pieces from the ice storage bucket 21. The ice storage bucket 21 rests on the L-shaped floor portion 15 when it is inserted into the ice compartment region 14. The ice storage bucket 21 may have a raised side wall portion 24 and raised rear wall portion 25 to help retain the clear ice pieces as they slide and fall into the ice storage bucket 21 from the automatic clear ice maker assembly 18 during harvest and during storage as the level of the clear ice pieces increases in the ice storage bucket 21. A level detection device such as a bail arm (not shown) is configured to turn the automatic clear ice maker assembly 18 on when the level of the clear ice pieces has gone below a preset level as the user removes the clear ice pieces from the ice storage bucket 21 for use, as well as turn off the automatic clear ice maker assembly 18 when the clear ice pieces have reached a preset full level in the ice storage bucket 21. Also, other level sensing devices could be used such as optical sensors.

In the embodiment of FIG. 1, a water tank 71, water outlet 72, water inlet 74, connecting piping and channels, and pump P (see FIG. 5) of the clear ice maker assembly 18 can be kept from freezing by insulating the water tank 71, connecting piping and channels, and pump P and by placing heaters (not shown) at the water tank 71, connecting piping and channels, and pump P as necessary. Alternatively, the water tank 71, water outlet 72, water inlet 74, connecting piping and channels, and pump P of the clear ice maker assembly 18 can be housed in a separate compartment that maintains an ambient temperature such that freezing is prevented. In this configuration, ice pieces are transferred to an adjacent compartment that is kept below freezing to prevent melting of the ice pieces.

While FIG. 1 shows the clear ice maker assembly 18 in the uppermost left corner of the freezer compartment 11 in the ice compartment region 14, the present disclosure also contemplates disposing the clear ice maker assembly 18 in a dedicated ice making compartment that is installed in the fresh food compartment of the refrigerator appliance, as will be discussed below with respect to FIG. 11.

As will be discussed in more detail below, the clear ice maker assembly 18 can be configured as one that utilizes direct cooling where an evaporator cooling tube or refrigerant tube 26 either contacts or is embedded in an evaporator plate 28.

Figure 2A:
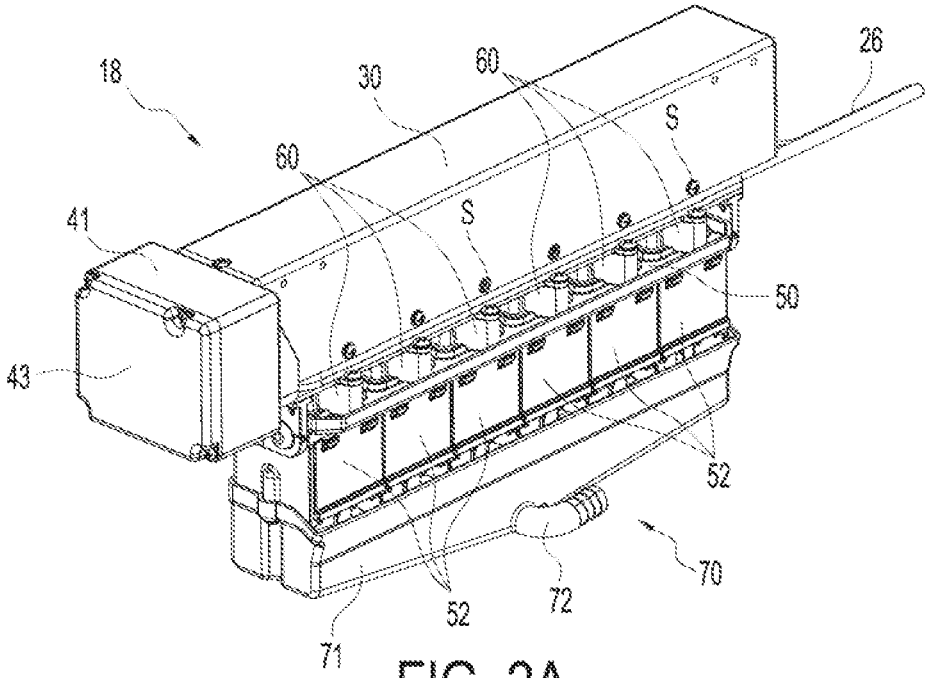
FIG. 2A is a perspective view of the automatic clear ice maker assembly according to an exemplary embodiment consistent with the present disclosure.

Turning to the particulars of the clear ice maker assembly 18 per se, reference is made to FIGS. 2A through 8. More specifically, FIGS. 2A and 2B are a perspective view and a perspective cutaway view, respectively, of the automatic clear ice maker assembly 18 according to an exemplary embodiment consistent with the present disclosure. FIGS. 3A and 3B are right side and front elevational views, respectively, of the automatic clear ice maker assembly 18, whereas FIGS. 4A and 4B are left side and back elevational views, respectively, of the automatic clear ice maker assembly 18 according to an exemplary embodiment consistent with the present disclosure.

With reference to FIGS. 2A, 2B, 3A, 3B, 4A, and 4B, the automatic clear ice maker assembly 18 includes an ice maker mounting bracket 30 which also serves as a housing or cover to protect an ice ejection system subassembly 40 from contamination and damage. The details of the ice ejection system subassembly 40 will be discussed in detail below with respect to FIG. 8. The ice maker mounting bracket 30 is mounted to, for example, a portion of the ice ejection system subassembly 40 such as a guiding plate 48 by fasteners such as screws or bolts S. The ice maker mounting bracket 30 can be used to suspend the clear ice maker assembly 18 inside refrigerator appliance 10. The ice maker mounting bracket 30 can either be directly mounted to the ceiling 17, for example, of the refrigerator appliance 10 or can be mounted to the ceiling 17 using mounting blocks 31 and 32 (see FIG. 2B) using suitable fasteners such as screws or bolts (not shown).

A gear box housing 41 for housing a gear box motor 42 (see FIG. 2B) for operating the ice ejection system subassembly 40 is disposed at the front of the ice maker mounting bracket 30. The gear box housing 41 includes a gearbox housing cover 43. The gear box motor 42 is mounted to the gear box housing 41 by fasteners F1, and the gearbox housing cover 43 is mounted to the gear box housing 41 by fasteners F2. The fasteners F1 and F2 can be screws or bolts (see FIG. 5).

Figure 2B:
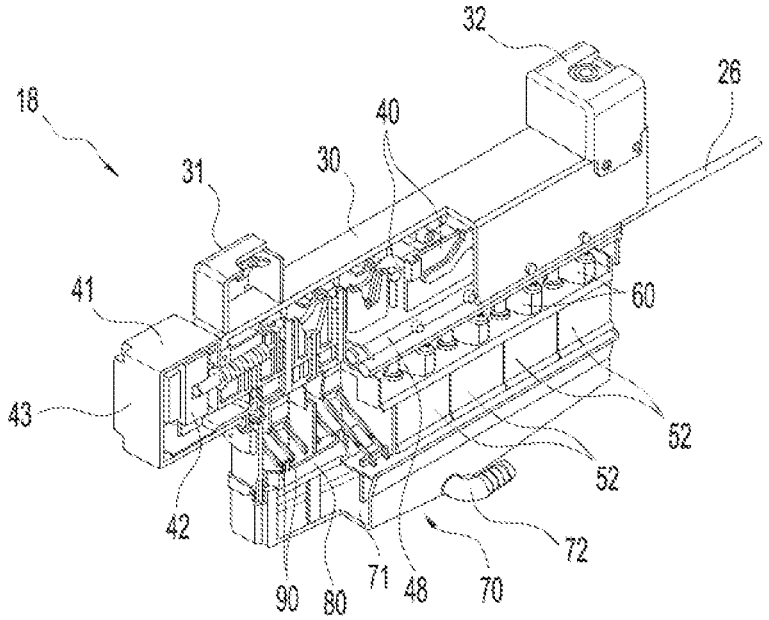
FIG. 2B is a perspective view of the automatic clear ice maker assembly with a partial cutaway and also showing mounting blocks according to an exemplary embodiment consistent with the present disclosure.
Figure 3B:
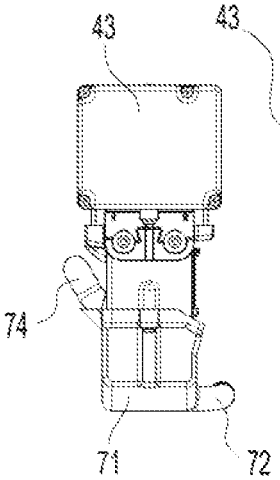
FIGS. 3A and 3B are right side and front elevational views, respectively, of the automatic clear ice maker assembly according to an exemplary embodiment consistent with the present disclosure.
Figure 3A:
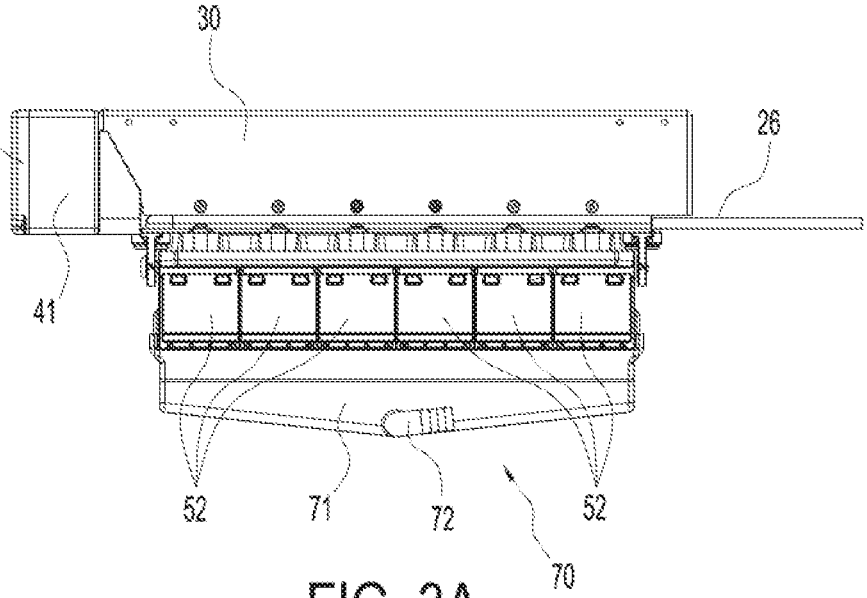
Figure 4B:
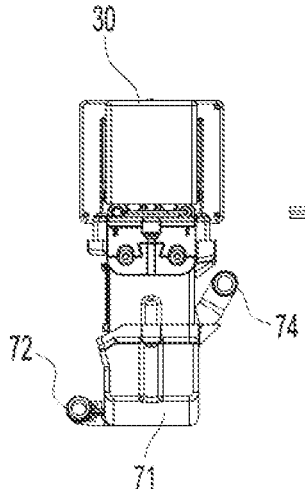
FIGS. 4A and 4B are left side and back elevational views, respectively, of the automatic clear ice maker assembly according to an exemplary embodiment consistent with the present disclosure.
Figure 4A:
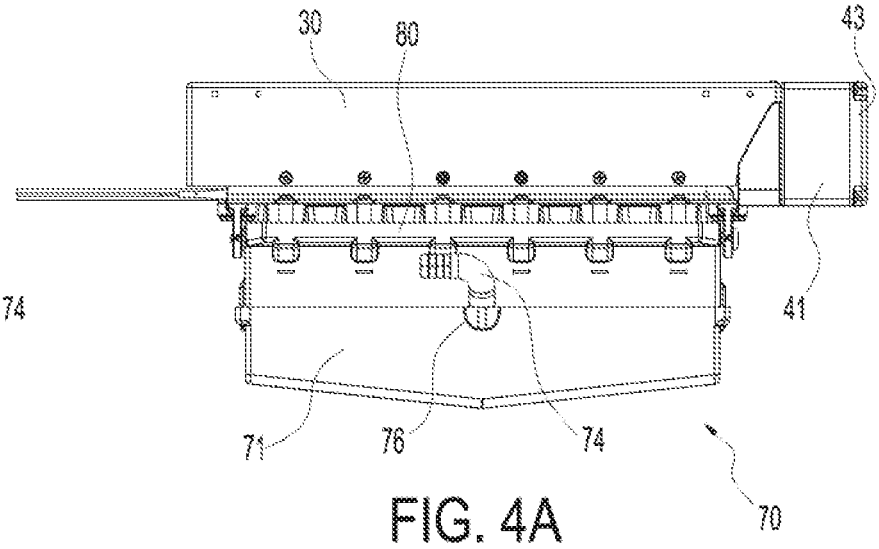

Also visible in FIGS. 2A and 2B is a splash guard 50 and an outer portion of each of a plurality of thermally non-conductive ice mold parts 60. In this case, while six ice mold parts 60 are shown, the present disclosure is not limited to this number and more or less ice mold parts 60 can be used. On the side of the splash guard 50, a plurality of hinged doors 52 (in this case six are shown) are situated adjacent to the thermally non-conductive ice mold parts 60 and are pivotally mounted to the splash guard 50.

A water reservoir system 70 is disposed below the thermally non-conductive ice mold parts 60 and comprises the water tank 71 and the pump P configured to supply water under pressure from the water tank 71 through the outlet 72 to a spray bar 80. As is visible in the cutaway view of FIG. 2B, a grate 90 disposed under the ice mold parts 60 and above the water tank 71 of the water reservoir system 70 and is configured to guide the harvested clear ice pieces to slide down into the ice storage bucket 21 and also allow any water to flow back into the water tank 71, as will be described in more detail below.

With reference to FIGS. 5, 6A, 6B, 7A, 7B, and 8, consistent with the present disclosure the evaporator plate 28 is cooled directly via contact with the refrigerant tube 26, wherein the refrigerant tube 26 is held to the evaporator plate 28 by a clamping plate 29 (see FIG. 5) using a plurality of fasteners S1 such as screws or bolts. The evaporator plate 28 arrangement is not limited to the embodiment shown, and could comprise an over-molded refrigerant tube, a roll-bond type assembly, or other known arrangements using direct cooling techniques. One or more heaters 27 are disposed above the evaporator plate 28 and are positioned between the evaporator plate 28 and the ice ejection system subassembly 40 (see FIG. 5). The heaters 27 may be affixed to the evaporator plate 28.

Figure 5:
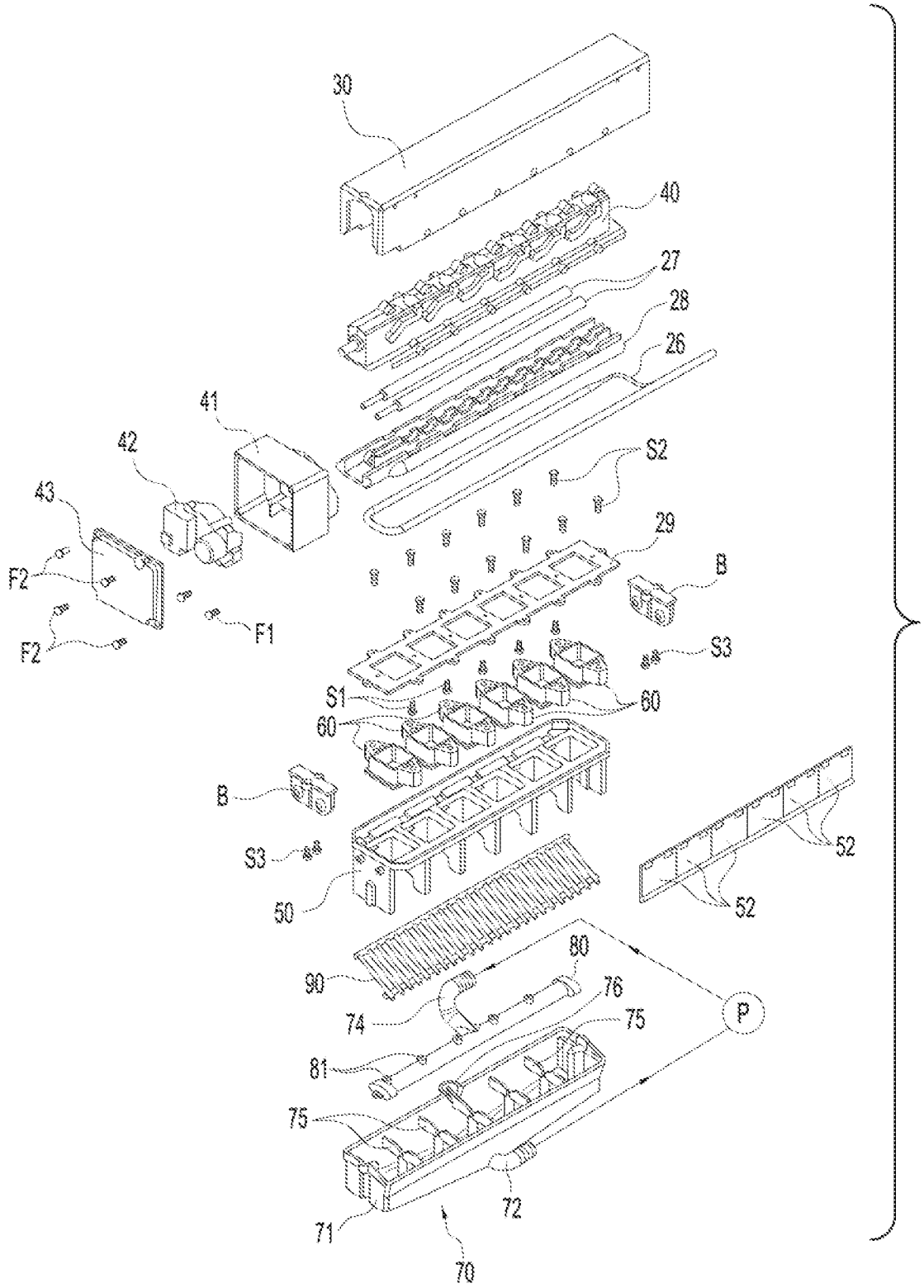
FIG. 5 is an exploded perspective view of the automatic clear ice maker assembly according to an exemplary embodiment consistent with the present disclosure.
Figure 6B:
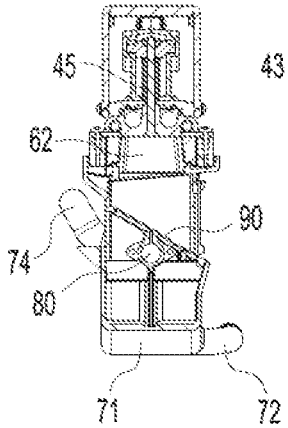
FIGS. 6A and 6B are cutaway right side and front elevational views, respectively, of the automatic clear ice maker assembly during an ice making or production mode according to an exemplary embodiment consistent with the present disclosure.
Figure 6A:
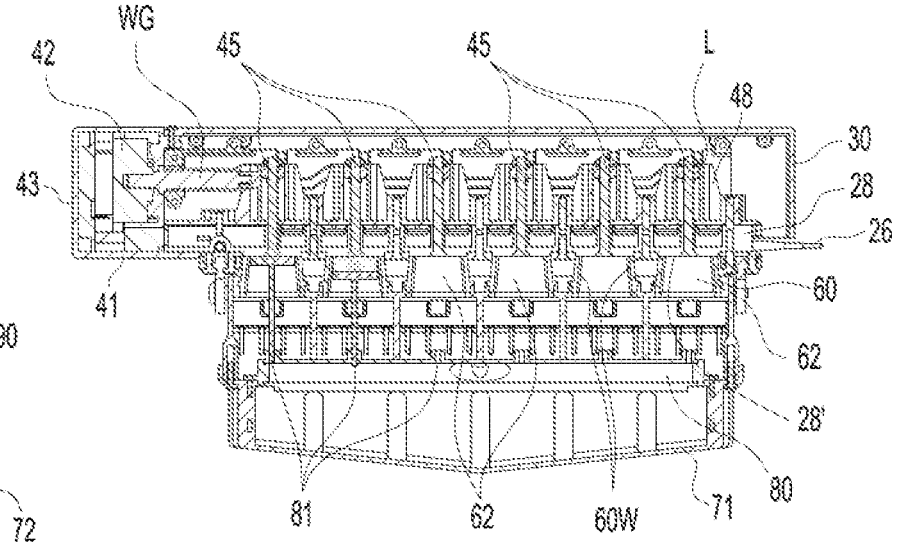
Figure 7B:
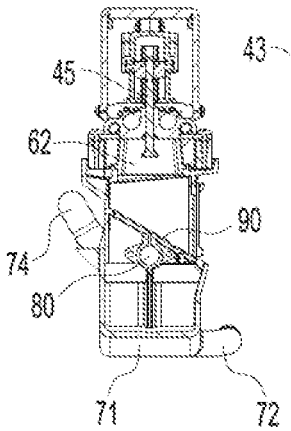
FIGS. 7A and 7B are cutaway right side and front elevational views, respectively, of the automatic clear ice maker assembly during an ice ejection or harvesting mode according to an exemplary embodiment consistent with the present disclosure.
Figure 7A:
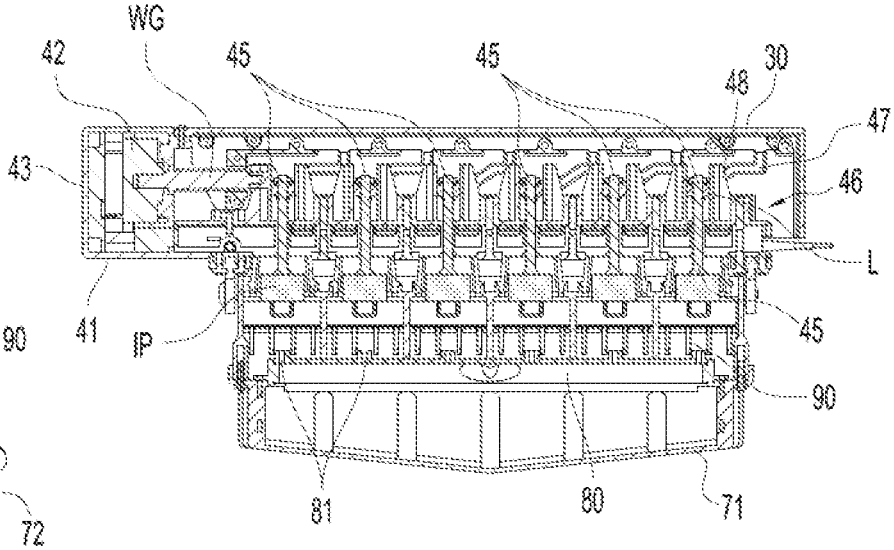

The one or more thermally non-conductive ice mold parts 60 are configured to have one or more walls 60W and are assembled below the evaporator plate 28 as best shown in FIGS. 6A and 10. As shown in FIG. 5, the thermally non-conductive ice mold parts 60 are removably mounted via fasteners S2 to the clamping plate 29 so as to be replaceable by a user, and therefore a wide variety of shapes and/or sizes are possible (see FIG. 10). The ice mold parts 60 can be assembled to the evaporator plate 28 by alternative means which may or may not include fasteners as shown in this embodiment, and it should be understood that these alternative assembly methods fall within the scope of this disclosure. The one or more walls 60W of the thermally non-conductive ice mold parts 60, in conjunction with a surface, such as a lower surface 28', of the evaporator plate 28, form a series of ice mold cavities 62 once these parts are assembled. Water, drawn from the water tank 71 of the water reservoir system 70, is introduced to the ice mold cavities 62 vertically by the spray bar 80. In the embodiment shown, water is pulled from the water tank 71 through the outlet 72 to an external pump P, which then discharges water to the spray bar 80 via the inlet 74. Many variations of this aspect of the automatic clear ice maker assembly 18 are possible, including an embodiment wherein the pump P is incorporated into the water tank 71, thus eliminating the requirement for external water piping. The spray bar 80 is configured as a pipe having a plurality (in this case six) vertically oriented holes or nozzle openings 81 which direct the water pumped from the water tank 71 up vertically into the respective ice mold cavities 62 and against the lower surface 28' of the evaporator plate 28, as shown in FIG. 6A. Note that the term "vertically" is used in a general sense to mean in an up and down direction or pointing/directed upwardly and is not limited to ninety degrees to a horizontal plane. As shown in FIG. 5, the spray bar 80 is supported by a plurality of T-shaped supports 75 mounted to, for example, the bottom and side walls of the water tank 71. The side wall of the water tank 71 that faces the inner side wall of the refrigerator appliance 10 can include cutaway portion 76 to accommodate the inlet 74 to the spray bar 80. Water introduced to the ice mold cavities 62 returns to the water tank 71 of the water reservoir system 70 in order to be recirculated. This water is contained by the hinged doors 52 of the splash guard 50. The grate 90 serves to separate harvested ice from the water tank 71 of the water reservoir system 70 which is disposed below the ice mold cavities 62 and the spray bar 80. The assembly of the splash guard 50, the hinged doors 52, grate 90, the spray bar 80, and the water reservoir system 70 is suspended by brackets B that are attached to the clamping plate 29 using fasteners S3 such as screws or bolts. As noted above, the entirety of the automatic clear ice maker assembly 18 is suspended inside of the home refrigerator appliance 10 by the icemaker mounting bracket 30.

Figure 8:
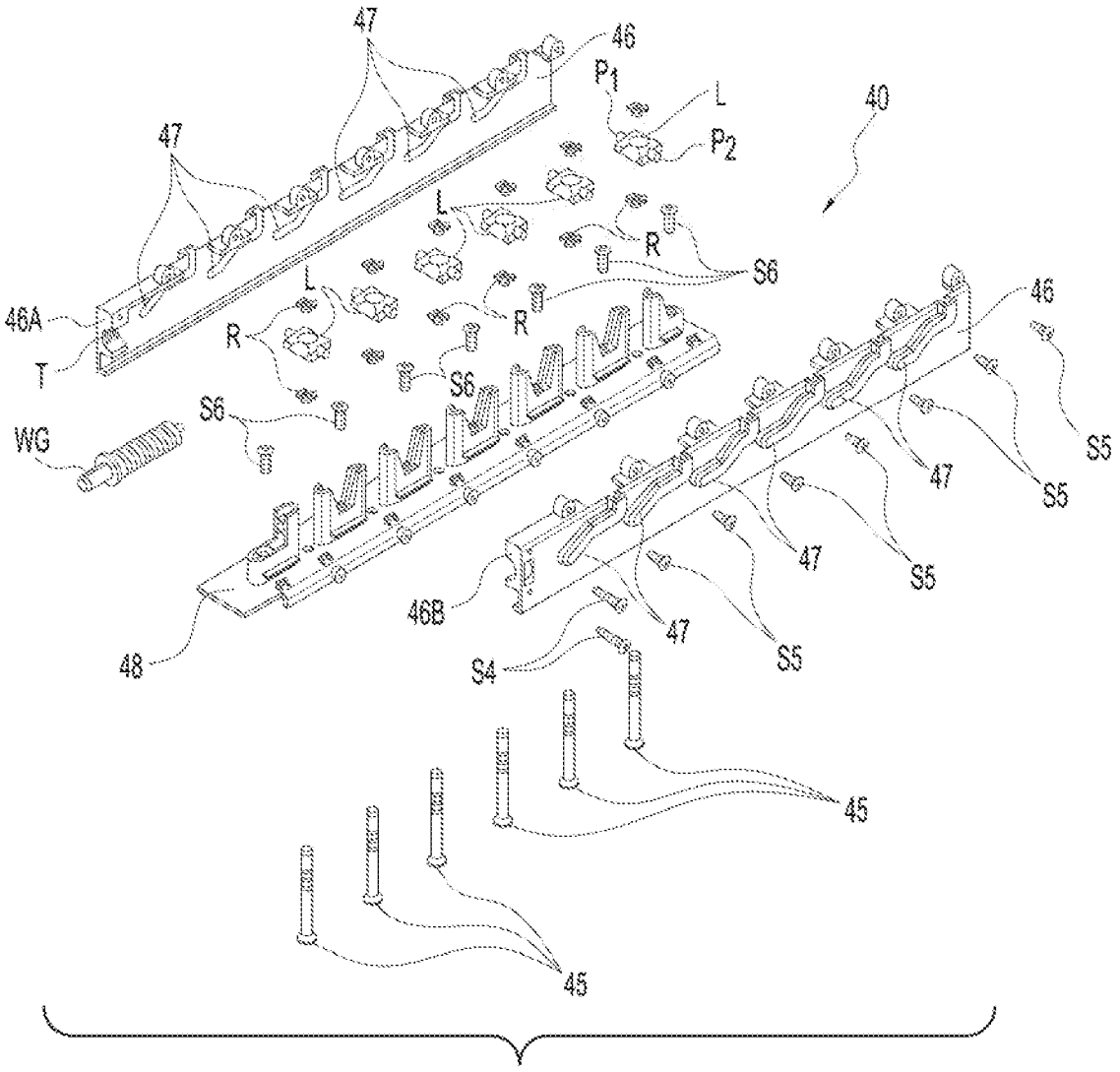
FIG. 8 is an exploded perspective view of the ice ejection system assembly according to an exemplary embodiment consistent with the present disclosure.

FIG. 8 is an exploded perspective view of the ice ejection system subassembly 40 according to an exemplary embodiment consistent with the present disclosure. In particular, the ice ejection system subassembly 40 serves to independently or simultaneously translate ejector pins 45 which push the clear ice pieces IP out of the ice mold parts 60. This is accomplished by converting rotational energy from the gearbox motor 42 to translational energy in the slider 46 which is formed by left and right slider halves 46A and 46B, and finally transferring that translational energy to the ejector pins 45. The input from the gearbox motor 42 (see FIG. 2B to FIG. 7) is used to drive a worm gear WG. Power is transmitted from the worm gear WG to gear teeth T on the slider 46, which is assembled from the two slider halves 46A and 46B. Power transmission allows for the slider 46 to be translated along its axis in either direction. The motion of the slider 46 is then transferred to a plurality of lifters L via pins $P_1$ and $P_2$ which ride along slots 47 in the slider 46. Finally, the lifters L are secured using retaining rings or clips R, such as but not limited to, C-clips, E-clips, or the like to the ejector pins 45. The ejector pins 45 pass through openings in the guiding plate 48 and in the evaporator plate 28 (see FIGS. 6A and 7A). Thus, the ejector pins 45 are driven up or down by the rotation of the gearbox motor 42. The amount of mechanical advantage can be determined by varying the geometry of the slots 47. All of these components are assembled to the guiding plate 48, which serves as a bearing for the worm gear WG (see FIGS. 6A and 7A) and also as a linear guide for the slider 46 and lifters L. The left and right slider halves 46A and 46B are joined together directly by fasteners S4 and S5 such as screws or bolts. The guiding plate 48 is fastened to the evaporator plate 28 by fasteners S6 such as screws or bolts.

In operation, the ice making cycle starts with an ice production mode that begins by passing refrigerant through the cooling tube 26, thus cooling the evaporator plate 28 to a predetermined temperature. The water in the water tank 71 is maintained at a predetermined temperature that best facilitates the ice making cycle. Water is pumped by the pump P from the water tank 71 into the spray bar 80 which introduces a stream of water from each hole or nozzle opening 81 directly into the center of each ice mold cavity 62 (see FIG. 6A). The water falls from each ice mold cavity 62 back down into the water tank 71 and is recirculated. The water in the water tank 71 is rapidly cooled to near 0° C. as a result of circulating over the evaporator plate 28. As water is circulated, ice forms only on the lower surface 28' of the evaporator plate 28 inside each ice mold cavity 62, growing only in the direction normal to the lower surface 28' of the evaporator plate 28. This occurs because the thermally non-conductive ice mold parts 60 are formed of, for example, plastic. The process is continued until the clear ice pieces IP have formed to a desired thickness. The desired thickness can be detected in a number of ways, such as by time and/or temperature based algorithms, monitoring the water level in the water tank 71, physically or optically probing the clear ice pieces IP, etc. Clear ice forms as all impurities and entrapped air are washed away, with the formation growing in a unidirectional manner due to the low thermal conductivity of the walls 60W of the one or more thermally non-conductive ice mold parts 60. A well-defined clear ice piece IP, having the shape of the walls 60W of the ice mold part 60, results. Thus, the shape of the clear ice piece IP produced can be varied significantly simply by the exchange of the ice mold parts 60 (see FIGS. 10A and 10B).

Once the clear ice pieces IP are fully formed, the ice production mode is complete and the water circulation is halted, and the clear ice pieces IP can then be harvested in the ice harvesting mode (see FIG. 7A) by ceasing the flow of refrigerant to the cooling tube 26 and energizing the heaters 27 which then warm the evaporator plate 28 to a predefined temperature setting, such as just above freezing. This is necessary to release the clear ice pieces IP from the lower surface 28' of the evaporator plate 28, and also to allow the ejector pins 45 to move freely. Once above 0° C. temperatures are reached at the evaporator plate 28, the ice ejection system subassembly 40 is actuated by the gearbox motor 42 situated inside the gearbox housing 41 and the gearbox cover 43. The gearbox motor 42 rotates the worm gear WG which in turn translates the slider 46. The slots 47 on the slider 46 engage the pins $P_1$ and $P_2$ of the lifters L. Each lifter L is driven downward by the slots 47 as the slider 46 translates. The ice ejection system subassembly 40 physically ejects the ice pieces IP from the ice mold parts 60 through the use of the ejector pins 45. Very limited melting occurs as only one face of the ice piece is in contact with the lower surface 28' of the evaporator plate 28. The plastic ice mold parts 60, which are not thermally conductive, do not facilitate any melting of the other faces. The ejector pins 45 may be made of metallic or non-metallic materials. The harvested clear ice pieces IP then slide along the grate 90 and through the hinged doors 52, which may be passively moved by the force of the clear ice pieces IP or alternatively moved by an actuator (not shown), thus allowing the clear ice pieces IP to leave the automatic clear ice maker assembly 18 and come to rest in the ice storage bucket 21 (see FIG. 1). Also, as the harvested clear ice pieces IP slide along the grate 90, this allows any small amount of melt water to return to the water tank 71. The ice making cycle is then complete, and can be reinitiated until ice level detection requirements for the ice bin are satisfied.

As ice making cycles are repeated, the magnitude of total dissolved solids (TDS) in the water within the reservoir system 70 increases. This requires that the water be periodically flushed from the water tank 71 and replenished with fresh water. Multiple embodiments are possible to facilitate this, wherein the preferred embodiment would allow for the water in the reservoir to be flushed and replenished automatically through a system of valves and directed to a drain, or the reservoir manually removed, flushed, and replaced by the user.

FIG. 9 is a front elevational view of the automatic clear ice maker assembly 18' showing a variation of the ice storage bucket according to an exemplary embodiment consistent with the present disclosure. In particular, as shown in FIG. 9, the ice storage bucket is configured as a side ice storage bucket 210 which is disposed beside the automatic clear ice maker assembly 18' (shown in a more simplified form) as opposed to both underneath and beside as is the case with the ice storage bucket 21 as shown in FIG. 1. In this case, the location of outlet 72 to the pump P is moved, for example, to the rear of the water tank 71' so as not to interfere with the side ice storage bucket 210, while the inlet 74' can remain in the same position.

FIG. 10A shows examples of the clear ice pieces IP of various shapes that are produced and FIG. 10B shows interchangeable, thermally non-conductive, ice mold parts 60 according to an exemplary embodiment consistent with the present disclosure. In particular, FIG. 10B shows various exemplary ice mold part 60 shapes formed by walls 60W and FIG. 10A shows ice piece IP shapes such as, but not limited to, a heart, a cube, various letters, a star, and animals.

FIG. 11 is a front cross-sectional view of a French door-bottom mount style refrigerator 1000 having a dedicated ice compartment 400, where the doors of the refrigerator are removed and the ice bucket with front cover of the ice compartment 400 is removed for ease of understanding according to an exemplary embodiment consistent with present disclosure. In particular, the dedicated ice compartment 400 is positioned in the upper left corner of a refrigerator compartment 1003. The refrigerator compartment 1003 is positioned over a freezer compartment 1002 of the French door-bottom mount style refrigerator 1000. The ice compartment 400 includes, for example, an insulated L-shaped wall that is configured to engage with a stepped portion of the inner side wall 1003B of the fresh food compartment 1003. The L-shaped wall of the ice compartment 400 cooperates with the inner top wall, the inner back wall, and the inner side wall 1003B of the fresh food compartment 1003 to form the insulated ice compartment. The automatic clear ice maker assembly 18" is disposed within the dedicated ice compartment 400.

The present invention has substantial opportunity for variation without departing from the spirit or scope of the present invention. For example, while FIG. 11 shows a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, while the dedicated ice compartment 400 is shown in the fresh food compartment in FIG. 11, the dedicated ice compartment 400 could be disposed in the freezer compartment 11 of FIG. 1. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A refrigerator comprising:

an ice compartment region disposed in at least one of a fresh food compartment or a freezer compartment;

a clear ice maker assembly disposed in the ice compartment region and configured to make clear ice pieces; and an ice storage bucket configured to store the clear ice pieces made by the clear ice maker assembly, wherein the clear ice maker assembly comprises:

an evaporator plate that is cooled via contact with a refrigerant tube;

at least one thermally non-conductive ice mold part disposed below the evaporator plate and having one or more walls that together with a lower surface of the evaporator plate form an ice mold cavity;

a spray bar having at least one opening for introducing water vertically into the ice mold cavity such that a clear ice piece forms on the surface of the evaporator plate inside the ice mold cavity of the at least one thermally non-conductive ice mold part;

a water reservoir configured to supply water to the spray bar; and an ice ejector configured to eject the clear ice piece formed inside the ice mold cavity of the at least one thermally non-conductive ice mold part and into the ice storage bucket, wherein the at least one thermally non-conductive ice mold part is formed of plastic; and wherein the clear ice forms only on the lower surface of the evaporator plate inside the ice mold cavity of the at least one thermally non-conductive ice mold part, growing in a direction normal to the lower surface of the evaporator plate, because the at least one thermally non-conductive ice mold part is formed of plastic.

2. The refrigerator of claim 1, wherein the at least one thermally non-conductive ice mold part comprises a plurality of thermally non-conductive ice mold parts each having one or more walls that together with the lower surface of the evaporator plate form a plurality of ice mold cavities for forming clear ice pieces.

3. The refrigerator of claim 2, wherein the ice mold cavities are configured in a variety of shapes and/or sizes.

4. The refrigerator of claim 3, wherein the thermally non-conductive ice mold parts are interchangeable such that the shape and/or size thereof are changeable.

5. The refrigerator of claim 2, wherein the spray bar comprises a plurality of openings respectively corresponding to the plurality of ice mold cavities.

6. The refrigerator of claim 2, wherein the ice ejector comprises a plurality of ejector pins configured to push out the clear ice pieces respectively formed inside the ice mold cavities during an ice harvesting mode.

7. The refrigerator of claim 6, further comprising a grate disposed under the ice mold cavities and above a water tank of the water reservoir and configured to guide the harvested clear ice pieces to slide down into the ice storage bucket and also allow any water to flow back into the water tank.

8. The refrigerator of claim 1, wherein the water reservoir comprises a water tank and a pump configured to supply water under pressure from the water tank to the spray bar.

9. The refrigerator of claim 1, wherein the ice ejector comprises at least one ejector pin configured to push out the clear ice piece formed inside the ice mold cavity of the at least one thermally non-conductive ice mold part during an ice harvesting mode.

10. The refrigerator of claim 1, wherein the at least one thermally non-conductive ice mold part is removably mounted to the lower surface of the evaporator plate so as to be replaceable by a user.

11. The refrigerator of claim 1, wherein the at least one thermally non-conductive ice mold part is removably mounted to the lower surface of the evaporator plate via a clamping plate so as to be replaceable by a user.

12. A clear ice maker assembly for use in a home refrigerator appliance, the clear ice maker assembly comprising:

an evaporator plate that is cooled via contact with a refrigerant tube;

at least one thermally non-conductive ice mold part disposed below the evaporator plate and having one or more walls that together with a lower surface of the evaporator plate form an ice mold cavity;

a spray bar having at least one opening for introducing water vertically into the ice mold cavity such that a clear ice piece forms on the surface of the evaporator plate inside the ice mold cavity of the at least one thermally non-conductive ice mold part;

a water reservoir configured to supply water to the spray bar; and an ice ejector configured to eject the clear ice piece formed inside the ice mold cavity of the at least one thermally non-conductive ice mold part, wherein the at least one thermally non-conductive ice mold part is formed of plastic; and wherein the clear ice forms only on the lower surface of the evaporator plate inside the ice mold cavity of the at least one thermally non-conductive ice mold part, growing in a direction normal to the lower surface of the evaporator plate, because the at least one thermally non-conductive ice mold part is formed of plastic.

13. The clear ice maker assembly of claim 12, wherein the at least one thermally non-conductive ice mold part comprises a plurality of thermally non-conductive ice mold parts each having one or more walls that together with the lower surface of the evaporator plate form a plurality of ice mold cavities.

14. The clear ice maker assembly of claim 13, wherein the ice mold cavities are configured in a variety of shapes and/or sizes.

15. The clear ice maker assembly of claim 14, wherein the thermally non- conductive ice mold parts are interchangeable such that the shape and/or size thereof are changeable.

16. The clear ice maker assembly of claim 13, wherein the spray bar comprises a plurality of openings respectively corresponding to the plurality of ice mold cavities.

17. The clear ice maker assembly of claim 13, wherein the ice ejector comprises a plurality of ejector pins configured to push out the clear ice pieces respectively formed inside the ice mold cavities during an ice harvesting mode.

18. The clear ice maker assembly of claim 17, further comprising a grate disposed under the ice mold cavities and above a water tank of the water reservoir and configured to guide the harvested clear ice pieces to slide down over the water tank and also allow any water to flow back into the water tank.

19. The clear ice maker assembly of claim 12, wherein the water reservoir comprises a water tank and a pump configured to supply water under pressure from the water tank to the spray bar.

20. The clear ice maker assembly of claim 12, wherein the ice ejector comprises at least one ejector pin configured to push out the clear ice piece formed inside the ice mold cavity of the at least one thermally non-conductive ice mold part during an ice harvesting mode.

21. The clear ice maker assembly of claim 12, wherein the at least one thermally non-conductive ice mold part is removably mounted to the lower surface of the evaporator plate so as to be replaceable by a user.

22. The clear ice maker assembly of claim 12, wherein the at least one thermally non-conductive ice mold part is removably mounted to the lower surface of the evaporator plate via a clamping plate so as to be replaceable by a user.

* * * * *